US007211327B2

(12) United States Patent
Galen et al.

(10) Patent No.: US 7,211,327 B2
(45) Date of Patent: May 1, 2007

(54) OIL AND WATER REPELLENT COMPOSITIONS AND METHODS OF APPLICATION THEREOF

(76) Inventors: Evan Galen, 1100 Park Ave., New York, NY (US) 10128; Andrew Barons, Box 300, Malmesbury, Siltshire (GB) SN160SE ( * ) Notice: Subject to any disclaimer, the term of this patent is extended or adjusted under 35 U.S.C. 154(b) by 51 days.

(21) Appl. No.: 11/217,965

(22) Filed: Aug. 31, 2005

(65) Prior Publication Data

US 2005/0285072 A1 Dec. 29, 2005

Related U.S. Application Data

(60) Division of application No. 09/872,314, filed on Jun. 1, 2001, now Pat. No. 7,008,993, which is a continuation-in-part of application No. 09/573,234, filed on May 18, 2000, now abandoned.

(51) Int. Cl.
*B32B 27/30* (2006.01)
*B05D 5/00* (2006.01)

(52) U.S. Cl. ..... 428/421; 427/393.4; 428/421; 428/540; 428/541; 428/908.8

(58) Field of Classification Search ..... 427/393.4; 428/421, 540–541, 908.8
See application file for complete search history.

(56) References Cited

U.S. PATENT DOCUMENTS

| | | | | |
|---|---|---|---|---|
| 4,075,237 | A | 2/1978 | Kleiner et al. | |
| 5,061,769 | A | 10/1991 | Aharoni | |
| 5,183,839 | A | 2/1993 | Aharoni | |
| 5,350,795 | A * | 9/1994 | Smith et al. | 524/507 |
| 5,374,686 | A | 12/1994 | Clikeman | |
| 5,414,047 | A | 5/1995 | Clikeman | |
| 5,674,961 | A | 10/1997 | Fitzgerald | |
| 5,725,789 | A | 3/1998 | Huber et al. | |
| 5,976,629 | A | 11/1999 | Wood | |
| 6,750,277 | B1 * | 6/2004 | Yamana et al. | 524/261 |

OTHER PUBLICATIONS http://www.dupont.com/teflon/carpetprotector/applic_dir.html.

* cited by examiner

*Primary Examiner*—Peter Szekely
(74) *Attorney, Agent, or Firm*—Fish & Neave IP Group Ropes & Gray LLP

(57) ABSTRACT

An oil and water repellent composition for protecting fabric, wool, and other substrates is described. The oil and water repellent composition comprises: (a) a cationic fluoroacrylate copolymer with a glass transition temperature near ambient temperature; (b) a cationic fluoroacrylate copolymer with a glass transition temperature of about 80° C. to about 100° C.; (c) a nonionic hydrophilic softener; and (d) an inorganic additive.

2 Claims, 1 Drawing Sheet

OIL AND WATER REPELLENT COMPOSITIONS AND METHODS OF APPLICATION THEREOF

CROSS-REFERENCE TO RELATED APPLICATIONS

This application is a divisional of U.S. application Ser. No. 09/872,314, filed Jun. 1, 2001, now U.S. Pat. No. 7,008,993, which is a continuation-in-part of U.S. application Ser. No. 09/573,234, filed May 18, 2000 now abandoned.

FIELD OF THE INVENTION

The present invention relates to oil and water repellent compositions for protecting substrates, including fiber-containing substrates, and other substances. The present invention also relates to substrates treated with a composition of this invention and to methods for treating substrates with the oil and water repellent compositions.

BACKGROUND OF THE INVENTION

Substrates such as woven fabrics, carpeting, upholstery and the like become soiled and stained when used, requiring frequent and repeated cleaning. Various chemical compositions have been proposed for the protection of such substrates against water and oil based soils and/or stains.

U.S. Pat. No. 4,075,237 relates to perfluorinated esters of fumaric acid and certain other ethylenically unsaturated poly-basic acid and soil repellant polymers thereof. Monomeric esters of fumaric, maleic, citraconic, mesaconic, itaconic, aconitic, or methylene malonic acid and alcohols of the formula $C_mF_{2m+1}C_nH_{2n}OH$ and mercaptans of the formula $C_mF_{2m+1}C_nH_{2n}SH$ form homopolymers and copolymers with other ethylenically unsaturated comonomers. These polymers have soil repellent properties and are useful in textile finishes.

U.S. Pat. No. 5,725,789 relates to aqueous oil and water repellent compositions. The compositions comprise (a) a polyalkoxyated polyurethane and (b) a fluorochemical acrylate polymer comprising the polymerized reaction product of a fluorinated acrylate or methacrylate monomer, at least one alkyl acrylate or methacrylate monomer and a polymerizable cationic emulsifier comprising a quaternary amine surfactant. Additionally, (c) a polyalkylene glycol fluorochemical acrylate copolymer and (d) a fluorochemical adipate ester can also be included within the compositions. The above components are blended together within the composition at a weight ratios of (a):(b), or (a)+(c):(b), or (a)+(c)+(d):(b) of from 19:1 to 1:19 and preferably about 1:1.

U.S. Pat. Nos. 5,061,769 and 5,183,839 relate to copolymer compositions derived from (a) perfluoralkylalkyl acrylate or methacrylate, (b) acrylic, methacrylic or itaconic acid, and (c) a hydroxyl-containing acrylate or methacrylate, which can be cross-linked through internal esterification or anhydride formation.

U.S. Pat. No. 5,674,961 relates to a copolymer composition for treating paper and paper products to impart water, oil or grease repellency comprising monomers copolymerized in the following percentages by weight: (a) from about 60% to about 90% of at least one monomer of formula I: $R_f$—Q—A—C(O)—C(R)=$CH_2$ (I) wherein $R_f$ is a $C_{2-20}$ straight or branched-chain perfluoralkyl group, R is H or $CH_3$, A is O, S or N(R'), wherein R' is H or a $C_{1-14}$ alkyl, Q is $C_{1-15}$, alkylene, $C_{3-15}$ hydroxyalkylene, —$(C_nH_{2n})$ $(OC_qH_{2q})$—, —$SO_2$—NR' $(C_nH_{2n})$—, or —CONR' $(C_nH_{2n})$—, wherein R' is H or $C_{1-4}$ alkyl, n is 1 to 15, q is 2 to 4, and m is 1 to 15; (b) from about 10% to about 40% of at least one monomer of formula II: $(R_1)_2N$—$CH_2$—O—C(O)—C($R_2$)=$CH_2$ (II) wherein $R_1$ is $C_{1-3}$ alkyl, $R_2$ is H or a $C_{1-4}$ alkyl radical, and wherein the nitrogen is from about 40% to 100% salinized; and, (c) from about 1% to about 7% of at least one monomer of formula III or IV, or a mixture thereof:

(III)

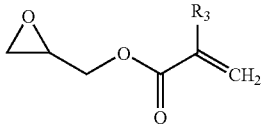

or Cl—$CH_2$—CH(OH)$CH_2$—O—C(O)—C($R_4$)=$CH_2$ (IV), wherein $R_3$ and $R_4$ are each independently H or the same or different $C_{1-4}$ alkyl radical.

U.S. Pat. Nos. 5,414,047 or 5,374,686 relate to a process for preparing a segmented copolymer of (a) a polyolefin, preferably (i) propylene homopolymer, (ii) a copolymer containing more than 90 percent by weight of units derived from propylene, (iii) ethylene homopolymer, or (iv) a copolymer containing more than about 90 percent of units derived from polyethylene, and (b) of a polymer comprised of greater than about 50 weight percent, preferably more than about 80 weight percent, of units derived from at least one alkyl (meth)acrylate, preferably methyl methacrylate.

U.S. Pat. No. 5,976,629 relates to a composition comprising a perfluorocarbon resin and a fluorocarbon liquid solvent which may be applied to an assembly, such as a printed circuit board. The dried composition provides protection for the coated surface from water and other harmful materials.

Many fluoropolymer applications, including those described above, have required the inclusion of significant amounts of organic solvents. In addition, many fabric protectors do not impart both oil and water repellent properties to the substrate, or require high temperature heat curing, which is inconvenient to use, particularly for the everyday consumer.

In addition, fabric protectors and other oil/water repellents typically are applied to a substrate using either an aerosol dispenser or a handheld spray bottle that must be squeezed by the user continuously in order to release the contents from the nozzle. In the field of carpet treatment, the consumer or industrial user is generally limited to steam or foam baths, or must immerse the unfinished carpet yarn. These previously available methods are expensive, time consuming, and/or cumbersome, particularly for the everyday consumer.

Applicants have solved these problems by providing fluoropolymer compositions that impart excellent oil and water repellent properties when applied to a substrate. The fluoropolymer compositions according to the present invention provide excellent oil and water repellent properties to both wool substrates and fiber based substrates, and to other substrates such as, for example, other fabrics, textiles, paper, leather, natural flooring, wood, stone, wallpaper, and tile. Applicants' compositions also impart anti-soiling properties to the substrate. In addition, the compositions according to the present invention may be applied and dried at ambient conditions with a reasonable drying time. Applicants have also provided a method of applying the oil/water repellent compositions using an air pressurized, non-aerosol spray bottle that is handheld and provides a continuous stream of the contents.

SUMMARY OF THE INVENTION

The present invention relates to a blend of fluoroacrylate copolymers and additives. The compositions of the present invention are water based and can be applied to substrates including wool, fiber-containing, textile, paper, leather, natural flooring, wood, stone, wallpaper, or tile substrate at ambient temperature to impart oil and water repellency and anti-soiling properties. The compositions of the present invention do not require high temperature treatment of the substrate following application of the compositions to the substrate. In addition, the compositions of the present invention may be applied to a substrate using a hand-held air pressurized, non-aerosol spray bottle applicator, a hand-held roller, or by treatment in a washing machine or dryer.

The present invention provides a composition comprising: (a) a cationic fluoroacrylate copolymer with a glass transition temperature near ambient temperature; (b) a cationic fluoroacrylate copolymer with a glass transition temperature of about 80° C. to about 100° C.; (c) a nonionic hydrophilic softener; and (d) an inorganic additive.

DETAILED DESCRIPTION OF THE INVENTION

Figure 1:
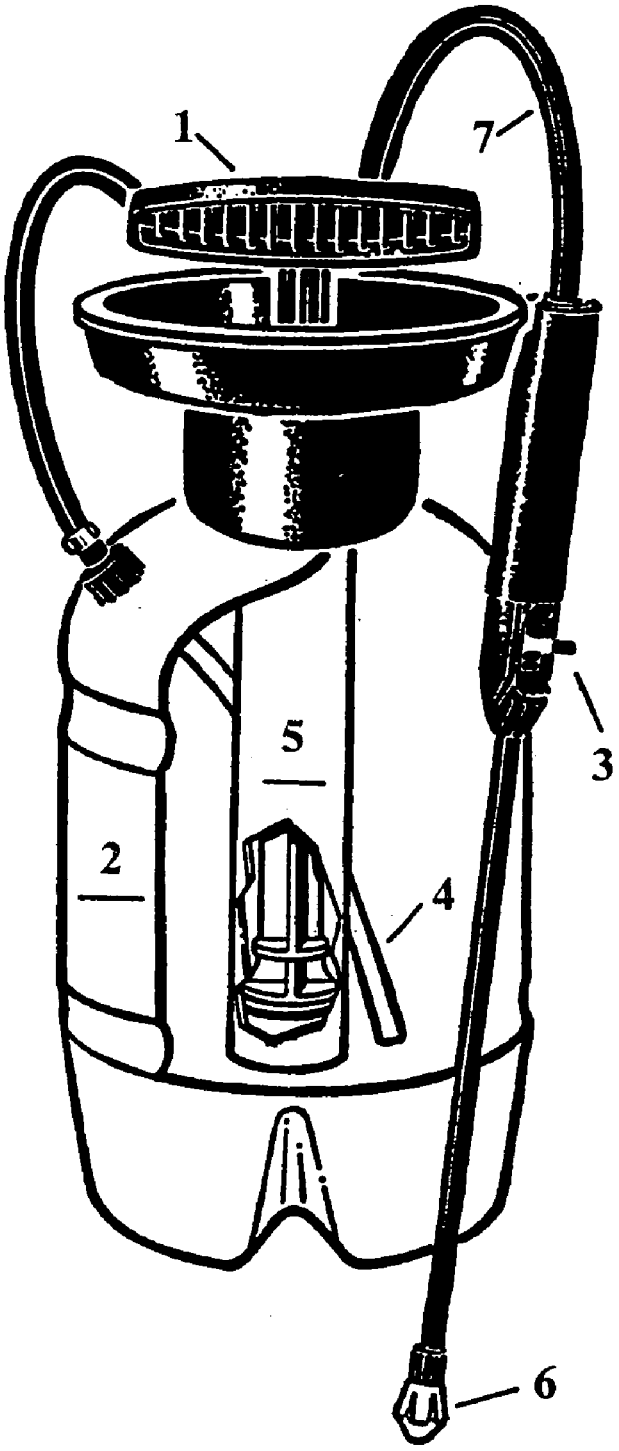
FIG. 1 depicts an applicator apparatus that may be used to apply compositions of this invention.

The present invention relates to a blend of fluoroacrylate copolymers, additives, and non-volatile solvents. The blends may be used to protect substrates such as, for example, fabrics, textiles, wool and non-wool carpeting, paper, leather, natural flooring, wood, stone, wallpaper, and tile from stains. The present invention may be used to impart oil and water repellency and anti-soiling properties to substrates. According to the present invention, substrates may be treated with the compositions and dried at ambient conditions without the need for heat treatment or special equipment. The oil and water repellent compositions of the present invention provide improved oil and water repellency and anti-soiling properties to substrates such as, for example, wool carpet, fiber based, textile, paper, leather, natural flooring, wood, stone, wallpaper, or tile substrates.

The present invention provides compositions that impart oil and water repellent finishes and are therefore useful to treat materials such as, for example, fabrics, textiles, wool and non-wool carpet, paper, leather, natural floors, wood, stone, wallpaper, tile and the like.

Accordingly, one embodiment of the present invention provides a composition comprising (a) a cationic fluoroacrylate copolymer with a glass transition temperature near ambient temperature; (b) a cationic fluoroacrylate copolymer with a glass transition temperature of about 80° C. to about 100° C.; (c) a nonionic hydrophilic softener; and (d) an inorganic additive.

The polymer compositions of the present invention are particularly valuable in fabric finishes. These compositions give finishes with superior resistance to washing, steam, dry cleaning, scrubbing, abrasion and crushing, both wet and dry, and also a better durability of the oil and water repellency. The oil and water repellent compositions of the present invention may also include additives, such as, for example, fragrances. It is a further object of the present invention to provide an oil and water repellent composition that maintains its repellency for long durations.

Advantageously, the oil and water repellent compositions of the present invention may be applied to a substrate by use of a hand-held air pressurized, non-aerosol spray bottle applicator, a hand-held roller, or by treatment in a washing machine or dryer.

The term "repellency", as used herein, refers to a reduced tendency for soil to adhere to a substrate and a reduced tendency for oil- and/or water-based liquids to penetrate into a substrate.

The term "repellent composition" as used here, means a composition comprising oil- and/or water-repellent chemicals dispersed, dissolved, or suspended in a solvent such as water or an organic solvent which will form a film-like barrier on the surface of a substrate or in the underlay of a substrate surface so that soiling liquids can no longer wet out the material. Accordingly, the hardness of the film-like barrier reduces the adhesion of pigment contamination and prevents liquid penetration. Advantageously, the breathing properties of the substrate are not altered.

The term "long duration", as used herein, means substantially resistant to damaging conditions, such as heat, steam, cleaning, soap solutions, and everyday wear and tear. Substrates treated with the oil and water repellent compositions of the present invention retain their repellency despite exposure to damaging conditions. The oil and water repellent compositions of the present invention may resist damaging conditions for a longer time than other repellent compositions.

The term "ambient", "ambient temperature" or "ambient conditions", as used herein, means at prevailing room temperature and humidity.

The term "substrate", as used herein, means the surface or object to which the oil and water repellent composition is applied.

According to a preferred embodiment, the compositions of the present invention provide superior oil and water repellent properties to the substrate. The compositions according to the present invention comprise a blend of fluoroacrylate copolymers and other components that provide an unexpected level of oil and water resistance to both fabric and wool-based substrates, and to other substrates such as, for example, other fabrics, textiles, paper, leather, natural flooring, wood, stone, wallpaper, and tile. Advantageously, the compositions of the present invention may also be air cured. Alternatively, the compositions of the present invention may be heat cured.

Oil and Water Repellent Composition

In one embodiment of the present invention is provided an oil and water repellent composition comprising: (a) a cationic fluoroacrylate copolymer with a glass transition temperature near ambient temperature; (b) a cationic fluoroacrylate copolymer with a glass transition temperature of about 80° C. to about 100° C.; (c) a nonionic hydrophilic softener; and (d) an inorganic additive. The fluoropolymer compositions of the present invention have excellent oleophobic and hydrophobic properties.

According to another embodiment, the invention provides compositions prepared by combining: (a) a cationic fluoroacrylate copolymer with a glass transition temperature near ambient temperature; (b) a cationic fluoroacrylate copolymer with a glass transition temperature of about 80° C. to about 100° C.; (c) a nonionic hydrophilic softener; and (d) an inorganic additive.

The oil and water repellent fluoropolymer compositions of the present invention are readily compatible with non-ionic, cationic, and anionic products. In addition, the compositions are compatible with a number of materials including, without limitation, home furnishing fabrics, textiles, wool and wool-blend carpets, paper, leather, natural flooring, wood, stone, wallpaper, and tile. The fluoropolymer compositions of the present invention are also compatible with extenders and cross-linking systems suitable for hydrophonic and oleophonic finishing.

According to a preferred embodiment, the oil and water repellent compositions of the present invention cause no change or insignificant change to the shade and colorfast properties of the substrate.

The oil and water repellent compositions according to the present invention preferably comprise a dispersion in water. In a preferred embodiment, the fluoropolymer compositions of the present invention comprises an emulsion with a density of about 1.02 g/mL at 25° C., and a pH of about 3–5. The emulsion may range in color from milky white to light yellow to clear, and may optionally further comprise additives such as, for example, fragrances. According to a preferred embodiment, the fluoropolymer composition has a flash point of greater than 100° C., and may be stored safely for prolonged periods at ambient temperature.

The cationic fluoroacrylate copolymer (a) is a cationic emulsion that may further comprise about 5% propylene glycol and is preferably water-based. This cationic fluoroacrylate copolymer (a) has a glass transition temperature Tg near ambient temperature. This relatively low Tg enables fluoroacrylate copolymer (a) to be air cured when used as a fabric protector. Advantageously, this property of fluoroacrylate copolymer (a) also enables the overall composition according to the present invention to be air cured.

Cationic fluoroacrylate copolymer (b) comprises a cationic emulsion that may further comprise about 5% dipropylene glycol methyl ether and less than about 10% diethylsuccinate. Cationic fluoroacryate copolymer (b) has a glass transition temperature Tg in the range of about 80° C. to about 100° C. Ordinarily, a polymer with a Tg in this range would require heat-curing to form a repellent film when used as a fabric protector. Unexpectedly, however, applicant's compositions comprising fluoroacrylate copolymers (a) and (b) may be air-cured to form a repellent film. Unexpectedly, applicants have found that the presence of (b) in the compositions according to the present invention imparts improved oil repellency while maintaining the desirable ability to air cure.

One of skill in the art will recognize that a polymer's glass transition temperature is determined in part by the conditions of polymerization. Both fluoroacrylate copolymers (a) and (b) may be assembled from fluoroacrylate monomers such as:

$$F—(CF_2—CF_2)_n—CH_2—CH_2—O—CO—CR{=}CH_2$$

wherein:

n is 3–6; and

R is H or methyl.

Specific conditions of polymerization for polymers such as (a) and (b) are well known to skilled practitioners.

Nonionic hydrophilic softener (c) is a polyester additive that improves the soil release properties and anti-static properties of the oil and water repellent composition.

Inorganic additive (d) is an emulsion of inorganic salts, preferably a paraffin dispersion containing zirconium salts. Inorganic additive (d) gives excellent water-repellency without affecting the handle of the substrate.

According to a preferred embodiment, the composition comprises fluoroacrylate copolymers (a):(b) in a ratio of greater than about 50:50. More preferably the ratio is greater than about 60:40. Still more preferably, the ratio is greater than about 70:30. Preferably, the ratio is less than about 85:15. More preferably, the ratio is less than about 80:20. Most preferably, the ratio (a):(b) is about 75:25.

Preferably, fluoroacrylate copolymers (a) and (b) comprise greater than about 5% of the composition by volume. More preferably, fluoroacrylate copolymers (a) and (b) comprise greater than about 10% of the composition by volume. Preferably, fluoroacrylate copolymers (a) and (b) comprise less than about 25% of the composition by volume. More preferably, flouroacrylate copolymers (a) and (b) comprise less than about 20% of the composition by volume. Most preferably, the fluoroacrylate copolymers (a) and (b) comprise about 15% of the composition by volume.

According to another preferred embodiment, hydrophilic softener (c) comprises more than about 0.1% of the composition by volume. Preferably, hydrophilic softener (c) comprises less than about 5% of the composition by volume. More preferably, hydrophilic softener (c) comprises less than about 2.5% of the composition by volume. Most preferably, the hydrophilic softener (c) comprises about 1% of the composition by volume.

According to a preferred embodiment, inorganic additive (d) comprises more than about 0.1% of the composition by volume. Preferably, inorganic additive (d) comprises less than about 5% of the composition by volume. More preferably, inorganic additive (d) comprises less than about 2.5% of the composition by volume. Most preferably, inorganic additive (d) comprises about 1% of the composition by volume.

Preferably, the composition is a water-based dispersion wherein water comprises more than about 65% of the composition by volume. More preferably, water comprises more than about 70% of the composition by volume. Preferably, water comprises less than about 90% of the composition by volume. Most preferably, water comprises about 80–85% of the composition by volume.

According to a most preferred embodiment, the composition comprises fluoroacrylate copolymers (a): (b) in a ratio of about 75:25, wherein fluoroacrylate copolymers (a) and (b) comprise about 15% of the composition by volume, hydrophilic softener (c) comprises about 1% of the composition by volume, inorganic additive (d) comprises about 1% of the composition by volume, and water comprises about 80–85% of the composition by volume.

One of skill in the art will recognize that the preferred compositions described above are diluted dispersions. Concentrated mixtures comprising: (a) a water-based cationic fluoroacrylate copolymer with a glass transition temperature near ambient temperature; (b) a cationic fluoroacrylate copolymer with a glass transition temperature of about 80° C. to about 100° C.; (c) a non-ionic hydrophilic softener; and (d) an inorganic additive are also within the scope of this invention, for example wherein (a):(b) is about 50:50 to 80:20, (a)+(b):(c) is about 25:1 to 1:1 and (a)+(b):(d) is about 25:1 to 1:1. According to a more preferred concentrated mixture, (a):(b) is about 75:25, (a)+(b):(c) is about 8:1, and (a)+(b):(d) is about 8:1.

According to a preferred embodiment, the oil and water repellent composition comprises fluoropolymers Nuva ACFPM (Clariant) or similar product: Nuva AGS (Clariant) or similar product in a ratio of greater than about 50:50. More preferably, the ratio is greater than about 60:40. Still more preferably, the ratio is greater than about 70:30. Preferably, the ratio is less than about 85:15. More preferably, the ratio is less than about 80:20. Most preferably, the ratio is about 75:25.

Preferably, fluoropolymers Nuva ACFPM (Clariant) or similar product and Nuva AGS (Clariant) or similar product comprise greater than about 5% of the composition by volume. More preferably, fluoropolymers Nuva ACFPM (Clariant) or similar product and Nuva AGS (Clariant) or similar product comprise greater than about 10% of the composition by volume. Preferably, fluoropolymers Nuva ACFPM (Clariant) or similar product and Nuva AGS (Clariant) or similar product comprise less than about 25% of the composition by volume. More preferably, fluoropolymers Nuva ACFPM (Clariant) or similar product and Nuva AGS (Clariant) or similar product comprise less than about 20% of the composition by volume. Most preferably, fluoropolymers Nuva ACFPM (Clariant) or similar product and Nuva AGS (Clariant) or similar product comprise about 15% of the composition by volume.

Preferably, hydrophilic softener Cassapret SRH (Clariant) or similar product comprises greater than about 0.1% of the composition by volume. Preferably, hydrophilic softener Cassapret SRH (Clariant) or similar product comprises less than about 5% of the composition by volume. More preferably, hydrophilic softener Cassapret SRH (Clariant) or similar product comprises less than about 2.5% of the composition by volume. Most preferably, hydrophilic softener Cassapret SRH (Clariant) or similar product comprises about 1% of the composition by volume.

Preferably, inorganic additive Cerol ZE (Clariant) or similar product comprises greater than about 0.1% of the composition by volume. Preferably, inorganic additive Cerol ZE (Clariant) or similar product comprises less than about 5% of the composition by volume. More preferably, inorganic additive Cerol ZE (Clariant) or similar product comprises less than about 2.5% of the composition by volume. Most preferably, inorganic additive Cerol ZE (Clariant) or similar product comprises about 1% of the composition by volume.

Preferably, the composition comprises greater than about 65% water. More preferably, the composition comprises greater than about 75% water. Preferably, the composition comprises less than about 90% water. More preferably, the composition comprises about 80–85% water.

According to a most preferred embodiment, the oil and water repellent composition comprises a ratio of about 75:25 of fluoropolymers Nuva ACFPM (Clariant) or similar product: Nuva AGS (Clariant) or similar product, wherein total fluoropolymer comprises about 15% of the composition by volume; about 1% of hydrophilic softener Cassapret SRH (Clariant) or similar product; about 1% inorganic additive Cerol ZE (Clariant) or similar product; and about 80–85% water.

In the above embodiments, products of the trade names Nuva ACFPM, Nuva AGS, Cassapret SRH, and Cerol ZE are available from Clariant as of applicant's filing date.

Method of Application

Typically, fabric protectors and oil/water repellents are applied to a substrate using either an aerosol dispenser or a hand-held spray bottle that must be squeezed by the user continuously in order to release the contents from the nozzle. This is particularly true of oil and water repellents and soil protectors that are available for home use by the consumer. In the field of carpet treatment, the consumer or industrial user is generally limited to steam or foam baths, or must immerse the unfinished carpet yarn. These available methods are expensive, time consuming, and/or cumbersome, particularly for the everyday consumer.

According to a preferred embodiment, applicants have provided a method of applying a fabric protector or oil/water repellent using an air pressurized, non-aerosol spray bottle that is hand-held and provides a continuous and even stream of the contents. The rate of application of the oil/water repellent will depend on the particular substrate, and the user may adjust the rate of application as appropriate. Advantageously, according to applicants' method of application, oil and water repellents may be applied at ambient temperature.

An illustrated hand-held oil and water repellent applicator system 10 according to one preferred embodiment is shown in FIG. 1. Tank 2 contains oil and water repellent composition. Pump 5 is pressurized using a few strokes of handle 1, and spray control lock 3 is turned to the "on" position. Liquid is drawn from tank 2 through supply tube 4 and hose 7 and sprayed through nozzle 6 onto the substrate. The intensity of the liquid stream can be adjusted as desired with nozzle 6.

According to another preferred embodiment, the oil and water repellent composition of the present invention may be applied to the substrate using a handheld, air pressurized non-aerosol spray bottle, such as the system shown in FIG. 1, that provides a continuous, even stream of composition for coating a substrate. The rate of application of the composition will depend on the particular substrate, and the user may adjust the rate of application as appropriate. Typically, the composition will be applied such that the substrate is lightly and evenly coated and just wet to the touch.

According to another embodiment, the oil and water repellent composition of the present invention may be applied to the substrate using a hand-held roller.

According to another embodiment, the oil and water repellent composition of the present invention may be applied to the substrate by treatment in a washing machine or dryer.

EXAMPLES

Spray Application and Curing Procedure

The composition is applied to the carpet sample at approximately 50 grams/meter using a spray applicator. Comparative fabric protectors were applied as per manufacturers instructions.

Oil Repellency Test

Treated carpet samples were evaluated for Oil Repellency using the AATCC Oil Repellency: Hydrocarbon Resistance Test. Oil Repellency is the ability of a textile fiber, yarn, or fabric to resist wetting by oily liquids. In this test, treated carpet samples were evaluated for penetration. Drops of standard test liquids, consisting of a series of hydrocarbons with varying surface tensions, were placed on the fabric surface and observed for wetting. Wetting of the fabric is evidenced by a darkening of the fabric at the liquid-fabric interface. The Oil Repellency Rating is the highest-numbered test liquid that does not wet the fabric surface after 30 seconds. The standard test liquids correspond to the following:

| Oil Repellency Rating Number | Composition |
|---|---|
| 1 | Nujol (liquid paraffin) B.P. Grade 1 |
| 2 | 65:35 Nujol: n-hexadecane by volume at 70° F. |
| 3 | n-hexadecane |
| 4 | n-tetradecane |
| 5 | n-dodecane |
| 6 | n-decane |
| 7 | n-octane |
| 8 | n-heptane |

Water Repellency

Samples were evaluated for water holdout. The standard test for water holdout requires a minimum of 5 minutes of water repellency to be evaluated as "satisfactory" at a particular rating. Treated samples were also monitored beyond the 5 minute minimum requirement to evaluate the approximate time length of repellency.

Example 1

Composition 1 according to the present invention was manufactured as follows:

To about 6 gallons of Nuva ACFPM (Clariant) was added about 2 gallons of Nuva AGS (Clariant). The fluoropolymer mixture was diluted to about 54 gallons with water. To the diluted mixture was added about one-half gallon of Cassapret SRH (Clariant) and one-half gallon of Cerol ZE (Clariant) to form oil and water repellent composition 1.

Example 2

Carpet Samples were treated with composition 1. An identical carpet Sample was treated with Scotchguard™ Water Based Protector.

Carpet Sample 1: 80% Wool/20% Nylon (Inca Pattern).

Carpet Sample 2: 50% Wool/50% Nylon.

Carpet Sample 3: 80% Wool/20% Nylon (Classic Wool Twist).

| Sample | Protector | Oil Rating | Water Holdout |
|---|---|---|---|
| 1 | Composition 1 | 7 | >5 minutes |
| 1 | Scotchguard (TM) | 2–3 | >5 minutes |
| 2 | Composition 1 | 7 | >5 minutes |
| 2 | Scotchguard (TM) | 2–3 | >5 minutes |
| 3 | Composition 1 | 8 | >5 minutes |
| 3 | Scotchguard (TM) | 4–5 | >5 minutes |

Although the water holdout for both systems is satisfactory, the oil repellency of the carpets is far better when treated with compositional than with the Scotchguard™ system. Although the standard test for water holdout only requires a minimum of 5 minutes repellency, the carpets treated with composition 1 prevented penetration of water indefinitely, whereas after 15–20 minutes the Scotchguard™ system started to fail and water was absorbed into the samples.

Thus a fabric protector composition and methods of applying such a composition to a substrate in order to protect the substrate are provided. One skilled in the art will appreciate that the present invention can be practiced by other than the described embodiments, which are presented for the purposes of illustration and not of limitation, and the present invention is limited only by the claims that follow.

What is claimed is:

1. A substrate having oil and water repellency, the oil and water repellency imparted to the substrate by an:

effective repellency enhancing amount of an oil and/or water repellent composition comprising (a) a cationic dispersion comprising a fluoroacrylate copolymer with a glass transition temperature at ambient temperature;

(b) a cationic dispersion comprising a fluoroacrylate copolymer with a glass transition temperature of about 80° C. to about 100° C.;

(c) a nonionic hydrophilic polyester softener; and (d) a water- and oil-repellent aid, comprising an emulsion of an inorganic salt.

2. A substrate having oil and water repellency, the oil and water repellency imparted to the substrate by a method comprising the steps of:

providing a substrate;

providing effective repellency enhancing amounts of an oil and/or water repellent composition comprising (a) a cationic dispersion comprising a fluoroacrylate copolymer with a glass transition temperature at ambient temperature;

(b) a cationic dispersion comprising a fluoroacrylate copolymer with a glass transition temperature of about 80° C. to about 100° C.;

(c) a nonionic hydrophilic polyester softener; and (d) a water- and oil-repellent aid, comprising an emulsion of an inorganic salt; and applying said oil and/or water repellent composition to said substrate by means of a hand-held roller or a hand-held air pressurized pump.

* * * * *